United States Patent [19]

Soltis

[11] Patent Number: 4,660,446

[45] Date of Patent: Apr. 28, 1987

[54] CAN TOP OPENER

[76] Inventor: Richard R. Soltis, 4291 New Rd., Austintown, Ohio 44515

[21] Appl. No.: 421,383

[22] Filed: Sep. 22, 1982

[51] Int. Cl.[4] ..... B67B 7/40

[52] U.S. Cl. ..... 51/3.55; 81/3.4

[58] Field of Search ..... 81/3.34, 3.1 R, 3.38 R, 81/3.38 A, 3.46 R, 3.46 A, 3.4, 3.44; 7/151; D8/33, 34, 40; 220/285

[56] References Cited

U.S. PATENT DOCUMENTS

| | | | |
|---|---|---|---|
| 1,954,422 | 4/1934 | McIntyre | 81/3.4 |
| 3,812,741 | 5/1974 | Heine | 81/3.4 |
| 4,253,352 | 3/1981 | O'Neal | 81/3.46 R |
| 4,309,921 | 1/1982 | Miller | 81/3.46 R |
| 4,414,865 | 11/1983 | Brooks et al. | 81/3.46 R X |

*Primary Examiner*—Frederick R. Schmidt
*Assistant Examiner*—Debra S. Meislin
*Attorney, Agent, or Firm*—Harpman & Harpman

[57] ABSTRACT

A tool for opening cans of the type having a weakened portion of the can top engagable by a lever and hinged downwardly into the can comprising a sleeve sized to receive the lever to a predetermined depth and operable to bend the weakened portion downwardly in a swinging action, the tool having tapered ribs within the sleeve that engage the lever in a wedging action securing the lever within the sleeve.

6 Claims, 5 Drawing Figures

CAN TOP OPENER

BACKGROUND OF THE INVENTION (1) Technical Field:

This invention relates to can top openers of the type utilized to open cans.

(2) Description of the Prior Art:

Prior art structures of this type have used a variety of different designs to engage and open cans of the type used for beverages or the like having a manipulative lever on the top of the can. A central portion of the can top is defined by a weakened boundry and is engaged by the lever and hinged downwardly into the can, (see for example U.S. Pat. Nos. 4,253,352 and 4,309,921).

In U.S. Pat. No. 4,253,352, a can opener is disclosed having a flattened sleeve which is slipped over the lever portion of the can top. Alternate forms of this device have a longitudinal slit along the bottom, or an outwardly extending tab adjacent one end.

In U.S. Pat. No. 4,309,921, a can opener is shown having a dependent bridge portion that engages the lever portion of the can top.

Applicant's device comprises a retangular member, one end of which has a transversely extending opening with a plurality of tapered ribs within that wedgingly engage the lever of the can top when engaged thereon.

SUMMARY OF THE INVENTION

A can top opener for cans of the type that have a nondetachable tab formed in the top that is forced downwardly into the can by a lever secured thereto. The can top opener wedgably engages the lever portion and opens the top by an upward swinging motion of the tool.

DESCRIPTION OF THE PREFERRED EMBODIMENT

Figure 1:
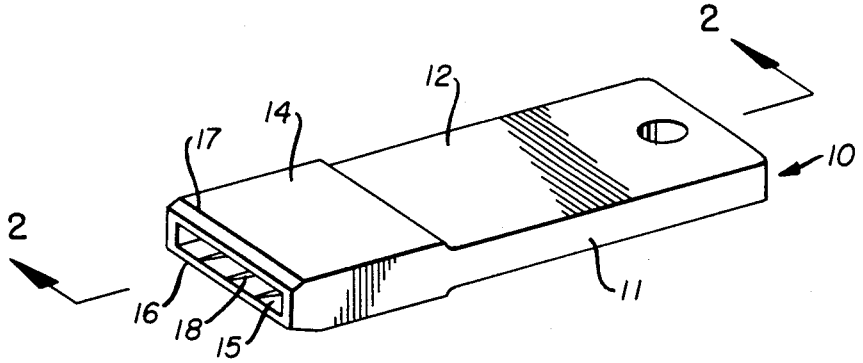
FIG. 1 is a perspective view of the tool.
Figure 2:
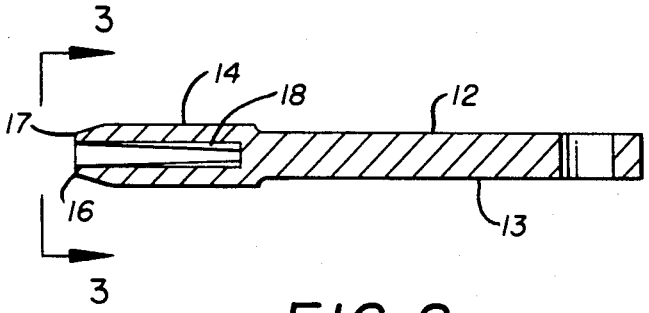
FIG. 2 is a cross section on lines 2—2 of FIG. 1.
Figure 3:
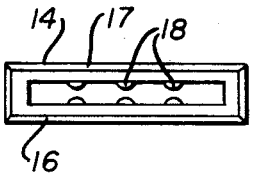
FIG. 3 is an end elevation on lines 3—3 of FIG. 2.

Referring to FIGS. 1, 2 and 3 of the drawings, a can top opener 10 can be seen comprising a retangular body member 11 having spaced parallel upper and lower surfaces 12 and 13 respectively.

An enlarged portion 14 which is hollow within defines one end of the opener 10. A transverse opening 15 is located in the end of the hollow enlarged portion 14 between end edges 16 and 17 which are tapered. A plurality of oppositely disposed tapered ribs 18 are formed longitudinally within the hollow interior and increase in height as they extend inwardly as best seen in FIG. 2 and 3 of the drawings.

Figure 4:
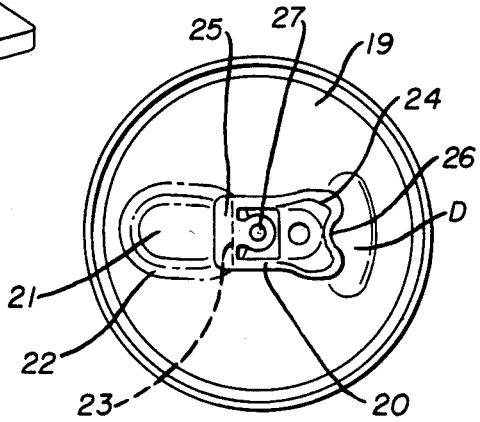
FIG. 4 is a top plan view of a can.

Referring now to FIG. 4 of the drawings, a can top 19 can be seen having a central zone 20 from which there extends radially a portion 21 with a weakened peripheral boundary 22 which is not weakened along a hinge line 23 adjacent the center of the can top 19. A lever 24 is provided above the surface of the can top 19 and includes a portion 25 which extends outwardly over the portion 21 in the opposite direction to a terminal end 26 spaced in relation to an attachment means 27 securing it to the can top 19. The lever is on a parallel plane spaced slightly above the can top 19 and in this particular can design has a depressed area D adjacent the terminal end 26 of the lever 24 which increases the spacing between the lever 24 and the can top.

Figure 5:
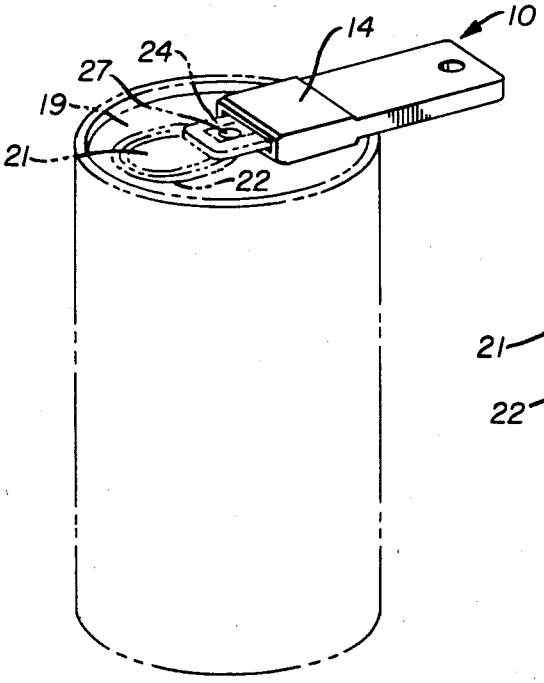
FIG. 5 is a perspective view of the tool engaged on the lever of the can top.

In use, the can top opener 10 is engaged on the lever 24 as seen in FIG. 5 of the drawings by sliding the opening 15 onto the terminal end 26 while the lower surface 13 and corresponding end edge 16 slides between the lever and the can top, it being thin enough to accomplish the insertion. As the lever 24 enters the hollow interior of the enlarged portion 14, it engages the tapered ribs 18 above and below and wedges therebetween. An upwardly lifting force is the applied to the opposite end of the opener 10 causing the lever portion 24 to engage the portion 21 and separation of the weakened peripheral boundary 22 from the can top 19.

The portion 21 is hinged on the hinge line 23 downwardly into the can as will be understood by those skilled in the art. The can top opener now in a vertical position is returned to the horizontal alignment with the can top 19 and removed for subsequent and similar use.

The wedging action of the can top opener onto the lever portion of the can top 19 effectively grips the lever 24 and holds the same in a predetermined depth inside the hollow interior of the enlarged portion 14. The positive positioning of the lever inside the can top opener to a predetermined depth decreases the possibility of misuse of the device in that if the can top opener is not properly engaged to its maximum extent over the lever portion of the can top, the bending action initiated upon the vertical movement of the opposite end of the can top opener will not supply adequate pressure on the weakened perimeter portion of the can top and thus not effectively open the can.

It will thus be seen that a new and useful can top opener has been illustrated and described and it will be apparent to those skilled in the art that various changes and modifications may be made herein without departing from the spirit of the invention and having thus described my invention what I claim is:

I claim:

1. A tool for opening cans of the type having a top surface with a central zone and a generally radially extending zone bounded by a weakened connection with the top surface of the can and which radially extending zone is adapted to be forcibly broken from the top surface in response to downward pressure and to be hingedly swung into the interior of the can along a bendable hinge line adjacent the central zone and wherein the can includes a lever with a portion extending over the radially extending zone and a portion extending to a terminal end and radially away from the radially extending zone towards, but not to the can periphery with the lever extending in parallel closely spaced relation to the can top and with the lever being fixed between the terminal end and the extending portion so that when the terminal end is lifted, a downward force is applied to the extending radial zone of the can top to break it from the top and to bend it into the can, said tool comprising:

a generally rectangular body member having spaced parallel upper and lower surfaces and spaced parallel side surfaces, portions of one end of said body member formed in closely spaced upper and lower sections and relatively widely spaced side sections defining a hollow area inwardly of said one end of said body member, spaced parallel tapered ribs on at least one of the opposed inner surfaces of said upper and lower sections defining said hollow area, said ribs being progressively thicker inwardly of said hollow area, a pair of thin end edges extending transversely on said upper and lower sections defining a transverse opening into said hollow area, said transverse opening and said hollow area being of a size to receive the portion of the lever extending to the terminal end thereof beyond the section of the lever fixed to the can top whereby said tapered ribs progressively engage said lever inwardly of its terminal end so as to temporarily hold said lever in fixed postion in the tool when the tool is lifted and thereby force the portion of the lever over the radially extending zone of the can top to engage said radially extending zone to break the same away from the top and bend into the can.

2. The tool of claim 1 and wherein said spaced parallel tapered ribs are formed on the inner surfaces of said upper and lower sections of said tool.

3. The tool of claim 2 wherein ribs on one of the inner surfaces of said hollow portion are offset sidewardly with respect to the ribs on the other inner surface of said hollow portion so as to be non-aligned vertically.

4. The tool of claim 2 wherein said ribs are in oppositely disposed relation to one another.

5. The tool of claims 4 or 1 or 2 wherein said ribs are tapered from thin portions adjacent said transverse opening toward thicker portions adjacent the inner end of said hollow area.

6. The tool of claim 1 wherein said thin end edges of said tool taper outwardly and oppositely from said one end of said body member.

* * * * *